US005340272A

United States Patent [19]

Fehlau

[11] Patent Number: 5,340,272

[45] Date of Patent: Aug. 23, 1994

[54] MULTI-STAGE CENTRIFUGAL PUMP INCORPORATING A SEALED THRUST BEARING

[75] Inventor: Rudolf Fehlau, Downey, Calif.

[73] Assignee: BW/IP International, Inc., Long Beach, Calif.

[21] Appl. No.: 932,069

[22] Filed: Aug. 19, 1992

[51] Int. Cl.[5] ..... F01D 11/04

[52] U.S. Cl. ..... 415/110; 415/104; 415/107; 415/111; 415/179; 277/3; 277/74; 277/81 R

[58] Field of Search ..... 415/110, 111, 112, 113, 415/177, 179, 104, 105, 107, 121.3; 277/3, 22, 74, 81 R

[56] References Cited

U.S. PATENT DOCUMENTS

| | | | |
|---|---|---|---|
| 1,112,518 | 10/1914 | Brown | 415/105 |
| 1,570,285 | 1/1926 | Schleyer . | |
| 1,837,873 | 12/1931 | Macmeeken | 415/105 |
| 2,000,874 | 5/1935 | Babb . | |
| 2,556,435 | 6/1951 | Mochri et al. . | |
| 2,999,702 | 9/1961 | Dunn et al. | 415/113 |
| 3,478,689 | 11/1969 | Ball . | |
| 3,718,406 | 2/1973 | Onal . | |
| 4,214,436 | 7/1980 | Romeyke et al. | 415/107 |
| 4,822,240 | 4/1989 | Marshall | 415/105 |
| 4,993,917 | 2/1991 | Kulle | 415/105 |
| 5,098,256 | 3/1992 | Smith | 415/111 |
| 5,102,308 | 4/1992 | Bordelon . | |
| 5,104,284 | 4/1992 | Hustak, Jr. et al. | 415/104 |
| 5,141,389 | 8/1992 | Bear et al. | 415/104 |

FOREIGN PATENT DOCUMENTS

| | | | |
|---|---|---|---|
| 121053 | 10/1984 | European Pat. Off. | 415/105 |
| 154543 | 11/1985 | European Pat. Off. . | |
| 72502 | 6/1979 | Japan | 415/106 |
| 99214 | 6/1982 | Japan | 415/112 |
| 140670 | 1/1991 | Japan | 277/74 |
| 557472 | 9/1992 | Switzerland | 415/112 |
| 641167 | 1/1979 | U.S.S.R. | 415/113 |

*Primary Examiner*—John T. Kwon
*Attorney, Agent, or Firm*—Pretty, Schroeder, Brueggemann & Clark

[57] ABSTRACT

A multi-stage centrifugal pump is described having a linear series of impellets mounted on a common impeller shaft, with axial thrusts imparted to the shaft by the impellets being balanced by a sealed high-pressure thrust bearing assembly secured to the pump casing. The pump is particularly suitable for using in pumping an abrasive fluid. A clean lubricating oil is supplied to the thrust bearing assembly at a pressure slightly greater than that of the abrasive pumped fluid, to ensure that the fluid that migrates across a mechanical seal interposed between the impeller assembly and the thrust bearing assembly is the lubricating oil, not the abrasive pumped fluid. High pressure differentials across a breakdown bushing involving the abrasive pumped fluid, and a resulting wear and erosion of pump components, thereby are avoided.

9 Claims, 2 Drawing Sheets

| Fig. 1a | Fig. 1b |
|---|---|

MULTI-STAGE CENTRIFUGAL PUMP INCORPORATING A SEALED THRUST BEARING

BACKGROUND OF THE INVENTION

This invention relates generally to multi-stage centrifugal pumps, and, more particularly, to pumps of this kind that generate high-axial thrusts.

Multi-stage centrifugal pumps ordinarily include a plurality of impellers mounted on a common impeller shaft rotatable within a housing. The impellers are arranged in series, with the discharge outlet of each impeller delivering pumped fluid or pumpage to the suction inlet of the next impeller. An inlet port in the housing delivers the fluid to the suction inlet of the first-stage impeller, and an outlet port in the housing receives high pressure fluid from the discharge outlet of the final-stage impeller.

Each impeller stage imparts an axial thrust to the rotating impeller shaft, and the combined axial thrusts of the impellers must be resisted or balanced in some manner. Frequently, the axial thrusts are balanced by arranging the impellers in a particular order and orientation on the shaft. For example, a first set of impeller stages can be arranged in side-by-side relationship at one end of the shaft, with all of those impellers oriented in a first direction, and a second set of impeller stages can be arranged in side-by-side relationship at the other end of the shaft, with all of those impellers facing in a second direction, opposite the first direction. A fluid passageway interconnects the discharge outlet of the final-stage impeller of the first set with the suction inlet of the first-stage impeller of the second set. The net axial thrust imparted to the rotating shaft is thereby balanced to a relatively low value.

The balanced multi-stage centrifugal pump described above functions generally satisfactorily to accommodate the axial thrusts being generated. However, it is nevertheless subject to drawbacks. A high pressure differential between the final-stage impeller of the first set and the adjacent final-stage impeller of the second set can cause a high-velocity flow of pumped fluid across a breakdown bushing located between these impellers. If the pumpage is at all abrasive, as frequently is the case, this high-velocity flow can lead to erosion of certain pump components and, ultimately, pump failure. Special steps can be taken in the design and construction of the breakdown bushing so as to accommodate this high pressure differential. However, it is not believed that the erosion problem can adequately be solved, and the pump still will have a limited lifetime.

Another technique for accommodating the high axial thrusts provided by multi-stage centrifugal pumps is to balance the thrust hydraulically. This requires the use of a special disk or drum and the accommodating of a high pressure differential by bleeding a high pressure to suction. This bleeding of high pressure pumpage leads to the very same erosion problem discussed above.

It should therefore be appreciated that there is a need for a multi-stage centrifugal pump that can accommodate the high axial thrusts provided by the pump's impellers without the need for a breakdown bushing for sealing a high pressure differential and without the need for undesired hydraulic balancing. The present invention fulfills this need.

SUMMARY OF THE INVENTION

The present invention is embodied in a multi-stage centrifugal pump having a sealed thrust bearing assembly for resisting the axial thrust developed by the pump's impellers. The pump avoids the need for a breakdown bushing that accommodates high pressure differentials. The pump is thereby particularly advantageous for use in pumping fluids that are highly abrasive.

More particularly, the multi-stage centrifugal pump of the invention includes a plurality of impellers mounted on a common rotatable shaft located within a casing. Each of the impellers operates to increase the pressure of a pumped fluid passing through it, from its suction inlet to its discharge outlet. A first-stage impeller is mounted with its suction inlet in fluid communication with an inlet port in the casing, and a final-stage impeller is mounted with its discharge outlet in fluid communication with an outlet port in the casing. The plurality of impellers are mounted in a predetermined sequence on the impeller shaft, with the first-stage impeller at one end and the final-stage impeller at the other end. The discharge outlet of all but the final-stage impeller is arranged to be in fluid communication with the suction inlet of the next succeeding impeller.

In the pump of the invention, a thrust bearing assembly is located within the casing and operatively connected to the impeller shaft, where it is separated from the final-stage impeller by a mechanical seal incorporating a controlled bypass. A fluid source supplies a lubricating fluid to the thrust bearing assembly at a pressure comparable to that of the pumpage present at the discharge outlet of the final-stage impeller, such that the pressure differential across the mechanical seal is relatively low. The thrust bearing assembly counteracts the thrust imparted to the shaft by the plurality of impellers.

The multi-stage centrifugal pump of the invention has particular utility when the pumpage includes an abrasive material. In such cases, the fluid source supplying the lubricating fluid to the thrust bearing assembly preferably provides a fluid pressure that is a predetermined amount higher than the pressure of the pumpage fluid at the discharge outlet of the final-stage impeller. This ensures that it is the lubricating fluid, which is non-abrasive, that flows through the controlled bypass of the mechanical seal, and the low pressure differential results in a relatively low fluid velocity. Erosion of the seal and final-stage impeller thereby is minimized. The fluid source preferably includes a positive displacement pump and related accessories, and the thrust bearing assembly preferably includes means for circulating the lubricating fluid through a heat exchanger.

A second mechanical seal seals the end of the impeller shaft adjacent to the first-stage impeller. This is the only mechanical seal required for sealing the pumpage fluid from the housing's exterior.

The plurality of impellers are preferably arranged in a linear sequence on the impeller shaft, with the discharge outlet of all but the final-stage impeller in fluid communication with the suction inlet of the immediately adjacent impeller. The pump is free of any separate means for hydraulically balancing the axial thrust provided by the impellers; rather, that axial thrust is taken up substantially solely by the thrust bearing assembly.

Other features and advantages of the present invention should become apparent from the following description of the preferred embodiment, taken in conjunction with the accompanying drawing, which illustrates, by way of example, the principles of the invention.

DESCRIPTION OF THE PREFERRED EMBODIMENT

Figures 1, 1A:
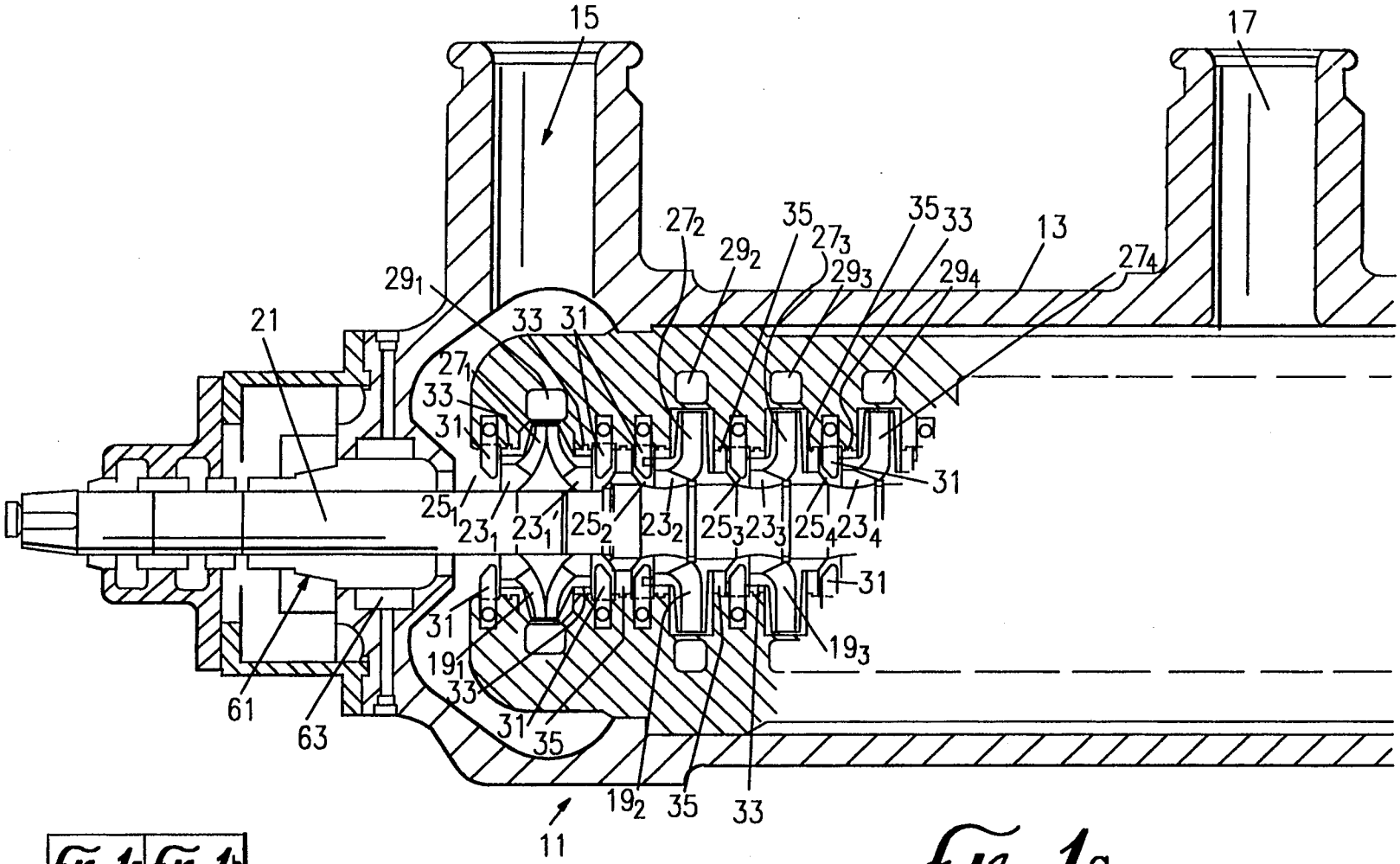
FIG. 1 shows a block diagram of FIG. 1*a* and FIG. 1*b* attached together.
FIGS. 1*a* and 1*b* together constitute a cross-sectional view of a multi-stage centrifugal pump, taken along the axis of the pump's impeller assembly.
Figure 1B:
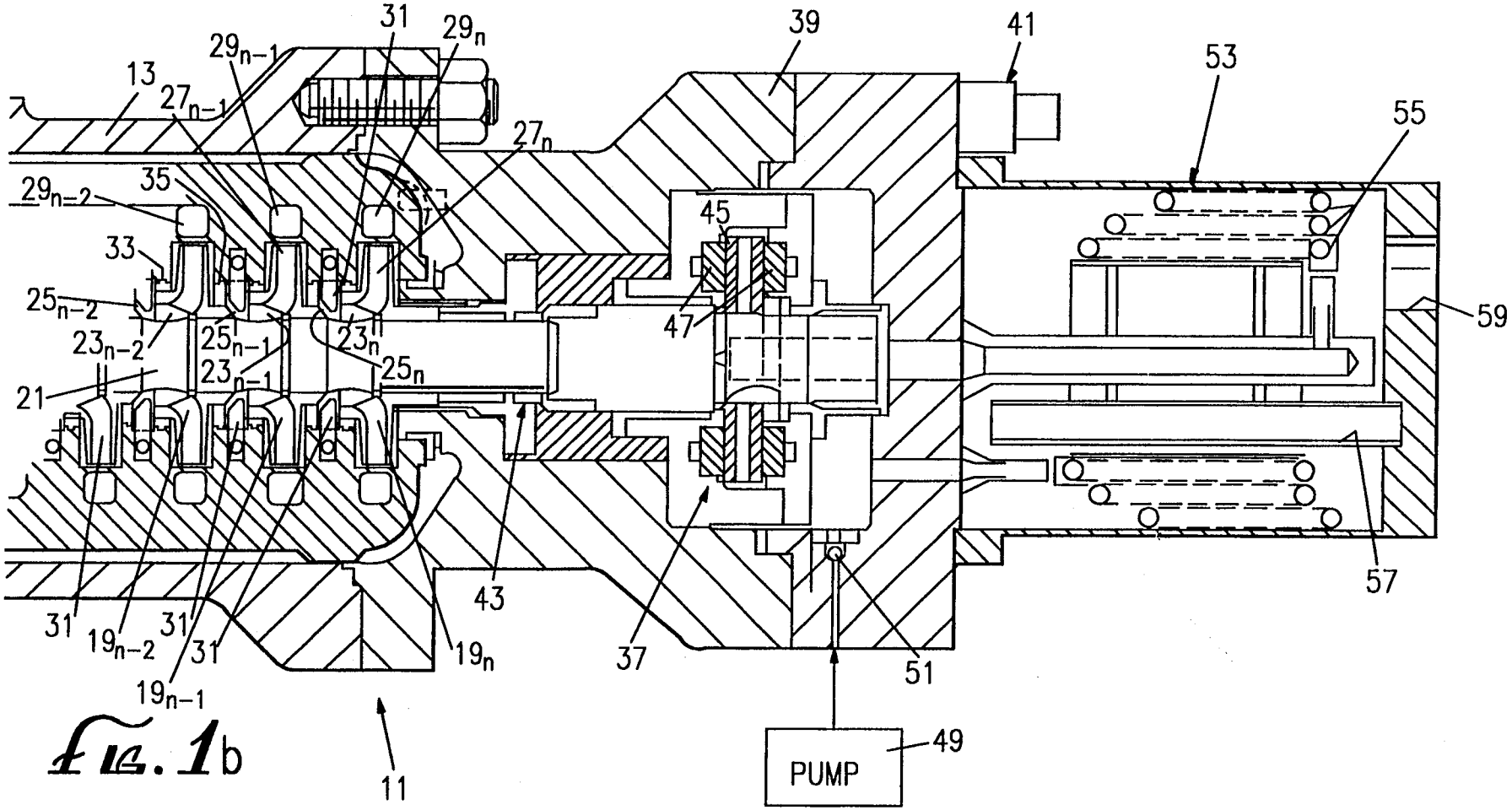

With reference now to the accompanying drawings, there is shown a multi-stage centrifugal pump 11 suitable for pumping a fluid containing an abrasive material such as sand. The pump includes an outer casing 13 having a pumpage inlet port 15 and outlet port 17. A plurality of impellers $\mathbf{19}_1$–$\mathbf{19}_n$ are mounted in side-by-side relationship on an impeller shaft 21 journaled within the casing. The shaft and impellers are rotatably driven by a suitable drive means such as a motor (not shown). The impellers are tightly fitted onto the impeller shaft and connected to the shaft by means of suitable keys and retainer rings (not shown). The casing further includes suitable journal housings and bearings (not shown) that support the impeller shaft within the casing.

Each impeller 19 includes a suction inlet 23 for receiving the pumped fluid or pumpage from a suction chamber 25 encircling the shaft 21 and a discharge outlet 27 for discharging the pumpage radially outwardly into a discharge chamber 29. Subscript numerals 1 through n are used to identify the particular impeller stage with which a specifically identified suction inlet, suction chamber, discharge outlet or discharge chamber is associated. Each impeller rotates within an annular chamber sized to accommodate the impeller and to define the discharge chamber adjacent its periphery. Passageways (now shown) are defined in the casing 13 to direct the pumpage from each discharge chamber 27 to the next succeeding suction chamber 25. In particular, a first passageway channels the pumpage from the first discharge chamber $\mathbf{29}_1$ to the second suction chamber $\mathbf{25}_2$, a second passageway channels the pumpage from the second discharge chamber $\mathbf{29}_2$ to the third suction chamber $\mathbf{25}_3$, and so on. Baffles 31 located in each suction chamber prevent a circumferential motion of the pumpage entering the suction inlet 23 of the adjacent impeller 19.

The suction inlet 23 of each impeller 19 encircles the impeller shaft 21 and is oriented to receive the pumpage generally axially along the shaft from the associated suction chamber 25. The discharge outlet 27 of each impeller is located at the impeller's outer periphery, and it is oriented to direct the pumpage radially outwardly into the encircling discharge chamber 29. In the special case of the first-stage impeller $\mathbf{19}_1$, it includes a second suction inlet $\mathbf{23}_1$ oriented in opposed relationship to the first suction inlet $\mathbf{23}_1$. This facilitates the flow of pumpage into the pump 11 via the inlet port 15.

Two types of wearing rings 33 and 35 are mounted in the casing 13, about the throat and hub of each impeller 19. Each throat ring 33 isolates the suction chamber 25 from the discharge chamber 29 of a particular impeller, while each hub ring 35 isolates the discharge chamber of that impeller from the suction chamber 25 of the next succeeding impeller. Complementary grooves (not shown) can be formed in the facing surfaces of the wearing rings and their associated impeller throats and hubs of the impellers, to create fluid flow restriction labyrinths that limit fluid leakage to a selected and acceptable rate.

The impellers 19 are configured such that their operation imparts a substantially axial force or thrust to the impeller shaft 21. This axial thrust, which is directed leftwardly in the drawings, arises because one entire side of each impeller is exposed to pumpage at a relatively high pressure, while only a part of the left side of that impeller is exposed to that same pressure with the remaining part of the left side of that impeller being exposed to pumpage at a comparatively lower pressure. The result is an axial thrust to the left, in the direction of the adjacent suction chamber 25.

In the past, the axial thrust imparted to the impeller shaft 21 by each impeller 19 has been balanced by sequencing and orienting the impellers such that approximately half of them impart an axial thrust in one direction while the remaining half impart an axial thrust in the opposite direction. When pumping abrasive fluids, however, this configuration has led to significant problems of erosion and limited lifetime.

In the centrifugal pump 11 of the invention, the impellers 19 are all oriented in the same direction on the impeller shaft 21, such that the axial thrusts they provide are additive, directed leftwardly in the depicted embodiment. This axial thrust is counterbalanced substantially entirely by a thrust bearing assembly 37 operatively connected to the impeller shaft. The thrust bearing assembly is housed within an enclosure 39 secured to the casing 13 by means of a number of threaded fasteners, one of which is shown at 41. A mechanical seal 43, which incorporates a controlled bypass, is interposed between the thrust bearing assembly and the final stage impeller $\mathbf{19}_n$.

The thrust bearing assembly 37 is a conventional structure having a thrust disk 45 sandwiched between two sets of tilting pads 47, in the presence of a lubricating oil. The thrust disk is secured to, and rotates with, the impeller shaft 21, while the two sets of tilting pads are secured in place within the enclosure 39. The lubricating oil is supplied to the assembly by a high-pressure pump 49, e.g., a positive displacement pump, via a ball valve inlet 51. The thrust disk is secured to, and rotates with, the impeller shaft 21, and any thrust-induced axial displacement of the disk and shaft is resisted by the tilting pads, with a thin film of the lubricating oil providing the required lubrication.

The lubricating oil of the thrust bearing assembly 37 is recirculated through a heat exchanger 53, for cooling. As depicted, this recirculation is provided by configuring the thrust disk 45 as an impeller. The pressure increase provided by the impeller forces the lubricating oil through tubing 55 of the heat exchanger. Cooling water circulates past the heat exchanger tubing by means of a water inlet 57 and outlet 59, to provide the required cooling.

The pump 49 provides a pressure for the lubricating oil that is slightly, e.g., 100 psi, greater than the pressure of the pumpage at the discharge outlet $\mathbf{27}_n$ of the final-stage impeller $\mathbf{19}_n$. This relatively small pressure differential can be readily accommodated by the mechanical seal 43 interposed between the final-stage impeller and the thrust bearing assembly. The lubricating oil pressure exceeds that of the pumpage, to ensure that lubricating oil, not pumpage, flows through the controlled bypass of the mechanical seal. Further, providing a relatively small pressure differential and ensuring that the lubricating oil is free of any abrasives ensures that erosion of the mechanical seal is minimized.

A conventional mechanical seal 61 is provided at the end of the impeller shaft 21 adjacent to the first-stage impeller $\mathbf{19}_1$. The seal can be a double seal with a buffer liquid supplied from an external pressurization source (not shown). A controlled amount of that buffer liquid is allowed to pass outwardly in both directions from the mechanical seal, to the suction inlet $\mathbf{23}_1$ of the first-stage impeller and to the exterior of the casing 13. A conventional cooling jacket 63 is depicted encircling the mechanical seal.

It should be appreciated from the foregoing description that the present invention provides an improved multi-stage centrifugal pump that is particularly effective in pumping an abrasive fluid without being subject to undue wear and erosion. The pump is specially configured to eliminate all high pressure differentials, which otherwise could cause high-velocity flows of the abrasive fluid.

Although the invention has been described in detail with reference only to the preferred embodiment, those having ordinary skill in the art will appreciate that various modifications can be made without departing from the invention. Accordingly, the invention is defined with reference to the following claims.

I claim:

1. A multi-stage centrifugal pump suitable for pumping an abrasive fluid, comprising:

a casing having an inlet port and an outlet port;

a shaft mounted for rotation within the casing;

a plurality of impellers mounted on the shaft, each impeller operable to increase the pressure of a pumped fluid passing through it, from a suction inlet to a discharge outlet, wherein a first-stage impeller is mounted with its suction inlet in fluid communication with the inlet port and a final-stage impeller is mounted with its discharge outlet in fluid communication with the outlet port, and wherein the plurality of impellers are mounted in a predetermined sequence on the shaft, with the first-stage impeller at one end and the final stage impeller at the other end, and with the discharge outlet of all but the final stage impeller in fluid communication with the suction inlet of the next succeeding impeller;

a sealed thrust bearing assembly operatively connected to the shaft, adjacent to the final-stage impeller;

a fluid source for supplying to the thrust bearing assembly a lubricating fluid having a pressure that is a predetermined amount higher than the pressure of the pumpage fluid present at the discharge outlet of the final-stage impeller; and a first mechanical seal located between the final-stage impeller and the thrust bearing assembly such that the lubricating fluid flows through the first mechanical seal from the thrust bearing assembly to the final-stage impeller.

2. A multi-stage centrifugal pump as defined in claim 1, wherein the lubricating fluid flows at a predetermined rate through the first mechanical seal from the thrust bearing assembly to the final-stage impeller.

3. A multi-stage centrifugal pump as defined in claim 2, wherein the thrust bearing assembly includes a heat exchanger and means for circulating the lubricating fluid through the heat exchanger.

4. A multi-stage centrifugal pump as defined in claim 1, and further including a second mechanical seal located between the casing and the shaft, at the end of the shaft opposite the thrust bearing assembly, for limiting outward flow of the pumped fluid from the casing.

5. A multi-stage centrifugal pump as defined in claim 4, wherein the second mechanical seal is the only seal associated with the shaft for limiting outward flow of the pumped fluid from the casing.

6. A multi-stage centrifugal pump as defined in claim 1, wherein the pump is free of any means for hydraulically balancing an axial thrust provided by the plurality of impellers.

7. A multi-stage centrifugal pump as defined in claim 1, wherein the plurality of impellers are arranged in a linear sequence on the shaft, with the discharge outlet of all but the final-stage impeller in fluid communication with the suction inlet of the immediately adjacent impeller.

8. A multi-stage centrifugal pump as defined in claim 1, wherein the pump is free of any mechanical breakdown bushing for sealing a fluid pressure differential exceeding the pressure differential provided by a single impeller stage.

9. A multi-stage centrifugal pump suitable for pumping an abrasive fluid, comprising:

a casing having an inlet port and an outlet port;

a single impeller shaft mounted for rotation within the casing;

a plurality of impellers mounted in a linear sequence on the impeller shaft, each impeller operable to increase the pressure of a pumped fluid passing through it, from a suction inlet to a discharge outlet, and each impeller delivering the pumped fluid to the next succeeding impeller, wherein a first-stage impeller is mounted with its suction inlet in fluid communication with the inlet port and a final-stage impeller is mounted with its discharge outlet in fluid communication with the outlet port, and wherein the impellers all impart a commonly-directed axial thrust to the impeller shaft;

a sealed thrust bearing assembly located within the casing and operatively connected to the shaft, adjacent to the final-stage impeller, for counterbalancing the axial thrust imparted to the impeller shaft by the plurality of impellets, the thrust bearing assembly including a thrust disk secured to, and rotatable with, the impeller shaft, two sets of tilting pads for axially confining the thrust disk, a heat exchanger, and means for circulating a lubricating fluid through the heat exchanger;

a first mechanical seal located between the final-stage impeller and the thrust bearing assembly, the seal incorporating a controlled bypass; and a fluid source for supplying to the thrust bearing assembly a lubricating fluid having a pressure that is a predetermined amount higher than the pressure of the pumped fluid present at the discharge outlet of the final-stage impeller, such that lubricating fluid flows at a predetermined rate through the seal, from the thrust bearing assembly to the final-stage impeller.

* * * * *